US006244858B1

(12) United States Patent
Wang

(10) Patent No.: US 6,244,858 B1
(45) Date of Patent: Jun. 12, 2001

(54) MULTI-PURPOSE LIGHTER WITH CHILD RESISTANT DEVICE

(76) Inventor: Boqi Wang, 420 N. Lincoln Ave., #22, Monterey Park, CA (US) 91755

( * ) Notice: Subject to any disclaimer, the term of this patent is extended or adjusted under 35 U.S.C. 154(b) by 0 days.

(21) Appl. No.: 09/579,699

(22) Filed: May 26, 2000

(51) Int. Cl.[7] ..... F23D 11/36
(52) U.S. Cl. ..... 431/153; 431/255
(58) Field of Search ..... 431/153, 255, 431/345, 344, 266; 126/25 B, 404, 407, 414

(56) References Cited

U.S. PATENT DOCUMENTS 5,697,775 * 12/1997 Saito et al. ..... 431/153
5,980,242 * 11/1999 Man ..... 431/255

FOREIGN PATENT DOCUMENTS

WO 99/47855 * 9/1999 (WO) ..... 431/153
WO 99/60309 * 11/1999 (WO) ..... 431/153

* cited by examiner

*Primary Examiner*—James C. Yeung
(74) *Attorney, Agent, or Firm*—Raymond Y. Chan; David & Raymond Patent Group

(57) ABSTRACT

A multi-purpose lighter with child resistant device includes a lock member including a lock button and a locker arm wherein the lock button is arranged to drive the locker arm to move from a normally locking position to an unlocked position. The locker arm has an upper portion and a lower portion wherein the upper portion thereof is horizontally extended to a blocking wall of a trigger button for blocking up the trigger button from being pushed inwardly so as to lock up the trigger button from ignition. The lower portion of the locker arm is downwardly extended to a piezoelectric unit casing wherein a resilient element is mounted therebetween for applying an urging pressure against the locker arm so as to normally retain the lock member at said locking position. In order to ignite the multi-purpose lighter, a user must intentionally press the lock button down and remain it in an unlocked condition that the locker arm is offset from the blocking wall. Then, the user can push the trigger button inwardly in order to compress a piezoelectric unit to ignite the multi-purpose lighter.

16 Claims, 4 Drawing Sheets

MULTI-PURPOSE LIGHTER WITH CHILD RESISTANT DEVICE

BACKGROUND OF THE PRESENT INVENTION

1. Field of Invention

The present invention relates to a lighter, and more particularly to a multi-purpose lighter with child resistant device for preventing under age children from the usage of the multi-purpose lighter.

2. Description of Related Arts

Most accidental fire cases today, many were started by the ignorant usage of the lighter, especially a barbecue lighter used at home such as pilot light for stoves or outdoor activities such as fireplaces or camping. Those accidental fires are causes by ignorance of human mistakes, especially among young children. So, nowadays, both U.S. government and U.S. Consumer Product Safety Commission demand a safety device in every lighter including the barbecue lighter to prevent unwanted ignition accidentally or by a child.

Conventional lighter comprises a safety switch for locking up the ignition trigger so as to prevent the ignition trigger of the lighter from accidentally being depressed thereby causing an unintended ejection. One of the common safety switch type barbecue lighter is that the safety switch is perpendicularly mounted on the casing of the barbecue lighter with respect to the trigger wherein a resilient element mounted under the safety switch for rebounding the safety switch to its original position, so as to re-lock the barbecue lighter after every ignition.

In order to ignite the barbecue lighter, a user's thumb must press the safety switch downward while the user's finger must depress the trigger. After a short period of time, the resilient element will tend to loss its elastic properties since the size of the resilient element is short. In order to strengthen the resilient element, a longer resilient element can be used. However, the size of the resilient element is limited by the casing of the barbecue lighter. So, user may repeat the step of unlocks the safety switch many times until he or her ignites a fire in certain condition. Therefore, such incorporating mechanism may lead to different results depending on the user.

SUMMARY OF THE PRESENT INVENTION

A main object of the present invention is to provide a multi-purpose lighter with child resistant device for preventing under age children from the usage of the multi-purpose lighter.

Another object of the present invention is to provide a multi-purpose lighter with child resistant device normally locks up the downward ignition motion of the trigger button, so as to prevent any unwanted ignition of the lighter.

Another object of the present invention is to provide a multi-purpose lighter with child resistant device, wherein in order to depress the trigger button downwardly so as to ignite the lighter, the user must press down a lock button and remain the lock button in unlocking position. Therefore, children under five years old are unable to complete the ignition operation.

Another object of the present invention is to provide a multi-purpose lighter with child resistant device which not only normally retains in a locking condition, but also can automatically return to the locking condition after each ignition operation so as to prevent any unintentional ignition of the lighter.

Accordingly, in order to accomplish the above objects, the present invention provides a multi-purpose lighter, comprising:

a casing comprising a liquefied gas cavity and a piezoelectric unit casing which attached to the liquefied gas cavity and defines a trigger cavity therein, a gas emitting nozzle extended from and communicated with the liquefied gas cavity in the casing, an elongated nozzle tube mounting on a ceiling of the casing for encircling the gas emitting nozzle, a piezoelectric unit, which is disposed in the piezoelectric unit casing of the casing, comprising a movable operating part extended upwardly and an igniting tip extended adjacent to the gas emitting nozzle, a trigger button, which is disposed in the trigger cavity of the casing in a horizontally movable manner, being attached on the movable operating part of the piezoelectric unit in such a manner when the trigger button is pushed downward, the movable operating part of the piezoelectric unit is compressed for generating piezoelectricity and, at the same time, the gas emitting nozzle is actuated by a gas level to release gas within the liquefied gas cavity, and a child resistant device, comprising:

a lock member slidably disposed in the casing in a vertically movable manner comprising a lock button slidably mounted on a top wall of the casing and a locker arm downwardly extended into the trigger cavity in such a manner the locker arm is arranged to be driven by the lock button to move from a normally locking position to an unlocked position, a blocking wall formed on a top portion of the trigger button wherein the blocking wall is facing the locker arm, a resilient element which is disposed in the trigger cavity for applying an urging pressure against the locker arm so as to normally retain the lock button at the locking position, wherein at the locking position, the lock member is downwardly extended to the blocking wall for blocking up the trigger button from being pushed downwardly so as to lock up the trigger button from ignition, and that at the unlocked position, the lock member is moved to offset from the blocking wall such that the trigger button is capable of being pushed inwardly to ignite the multi-purpose lighter.

In order to ignite the multi-purpose lighter, the user must intentionally press the lock button down and remain it in an unlocked condition that the locker arm is offset from the blocking wall. Then, the user can push the trigger button to ignite the multi-purpose lighter. When the pushing force applied on the lock button is released, the resilient element will automatically rebound to its original form so as to force the locker arm to return to its original locking position.

DETAILED DESCRIPTION OF THE PREFERRED EMBODIMENT

Figure 1:
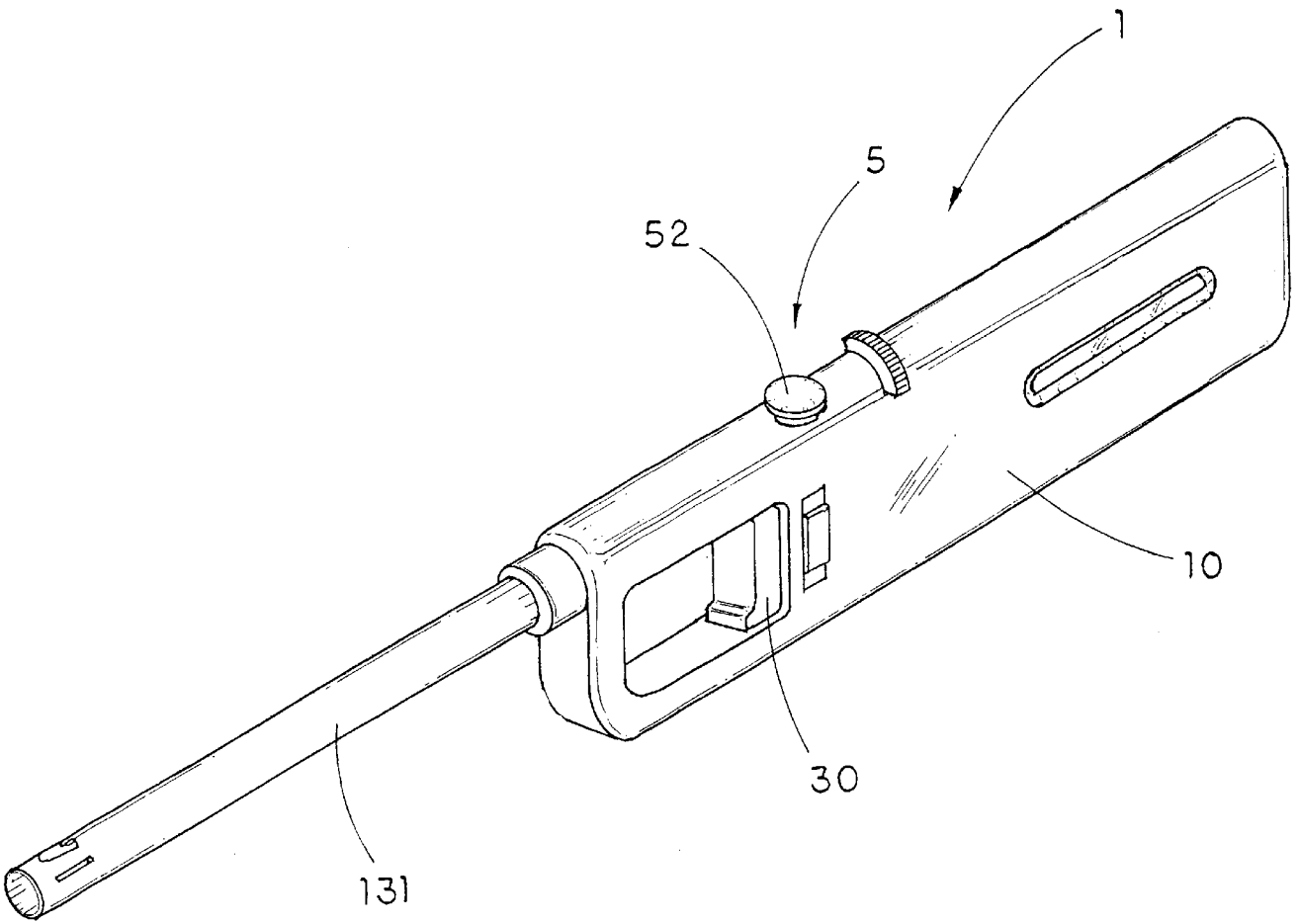
FIG. 1 is a perspective view of a multi-purpose lighter with child resistant device according to a preferred embodiment of the present invention.
Figure 2:
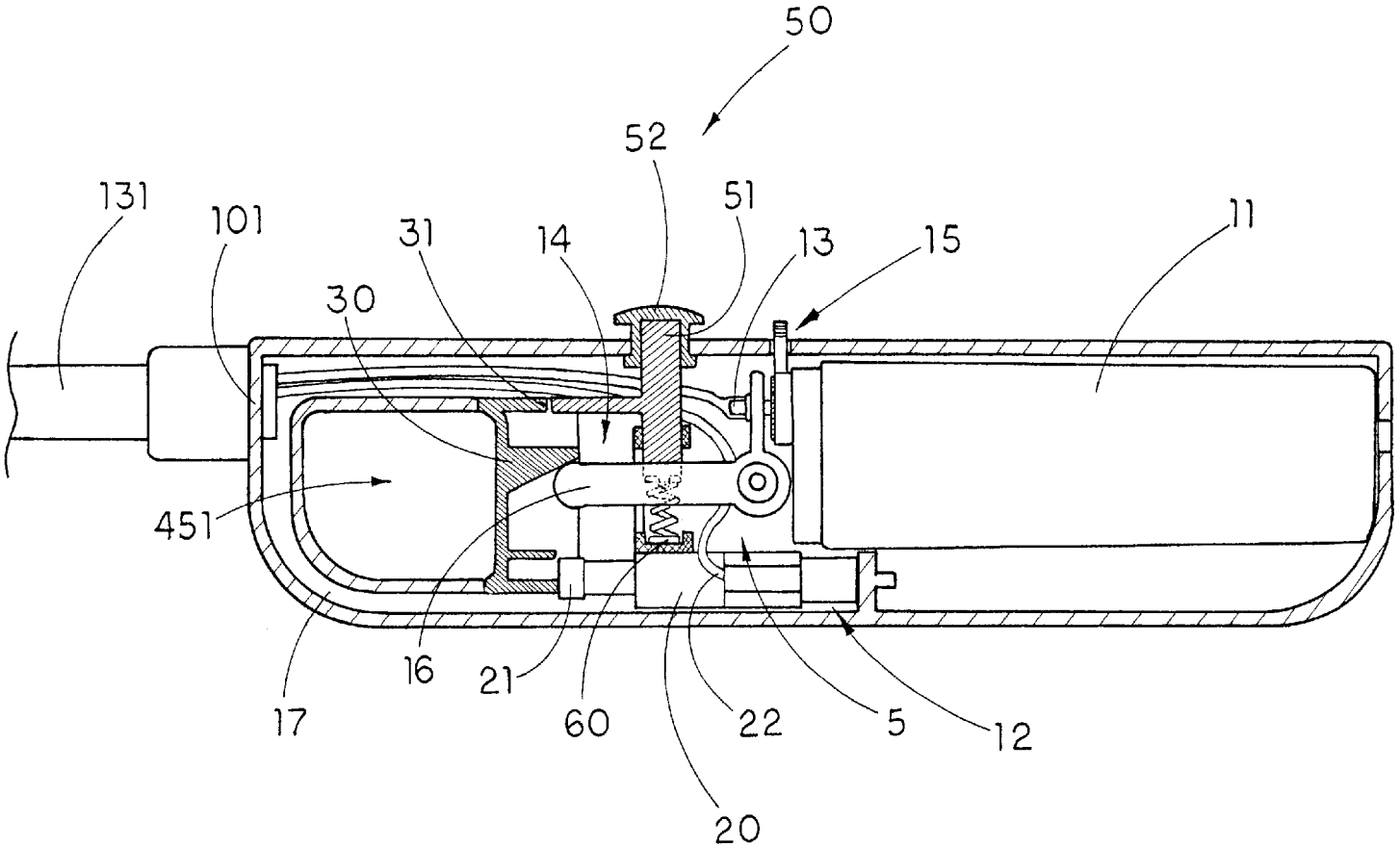
FIG. 2 is a sectional view of the multi-purpose lighter with child resistant device according to the above preferred embodiment of the present invention.
Figure 3:
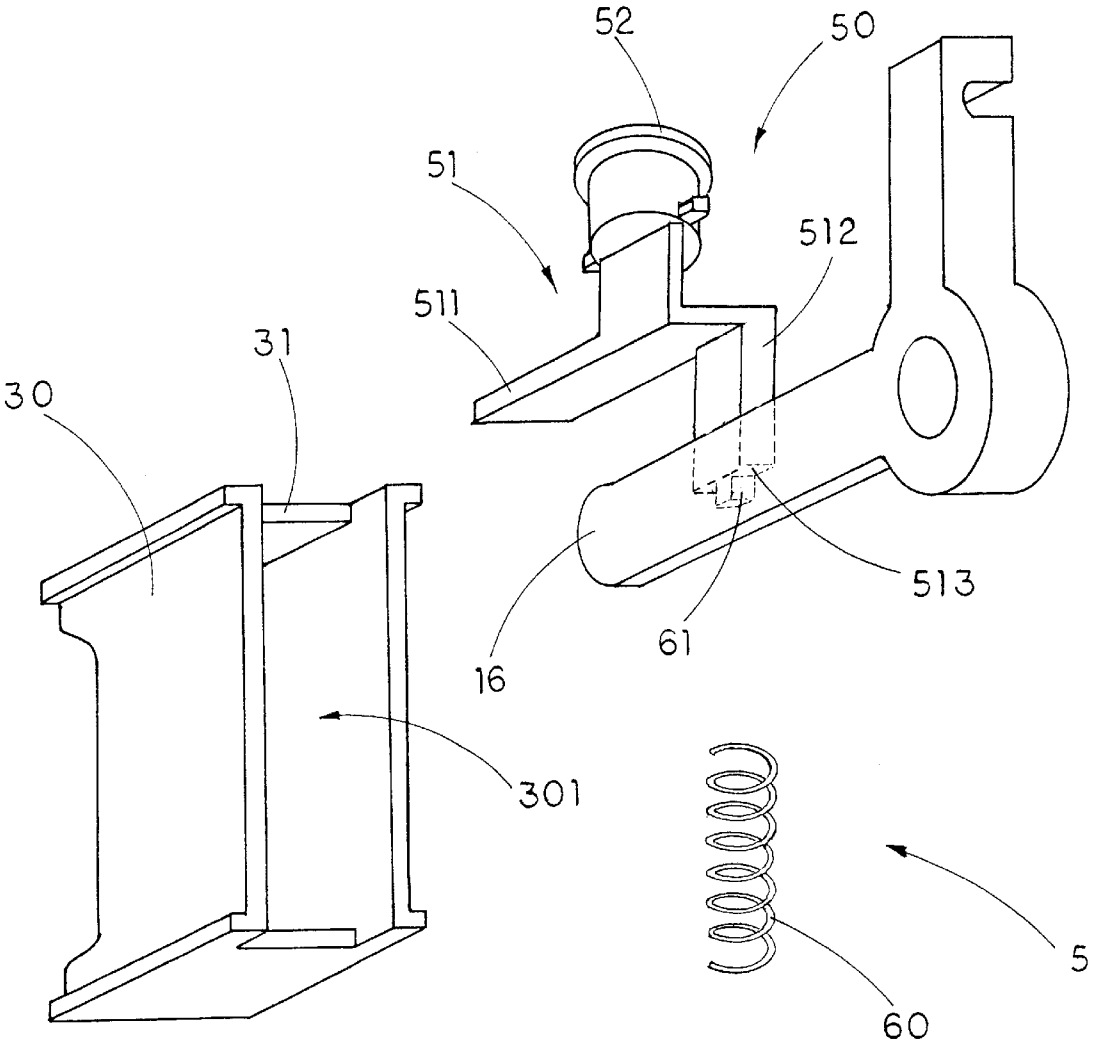
FIG. 3 is a partially exploded perspective view of the multi-purpose lighter with child resistant device according to the above preferred embodiment of the present invention.
Figure 4:
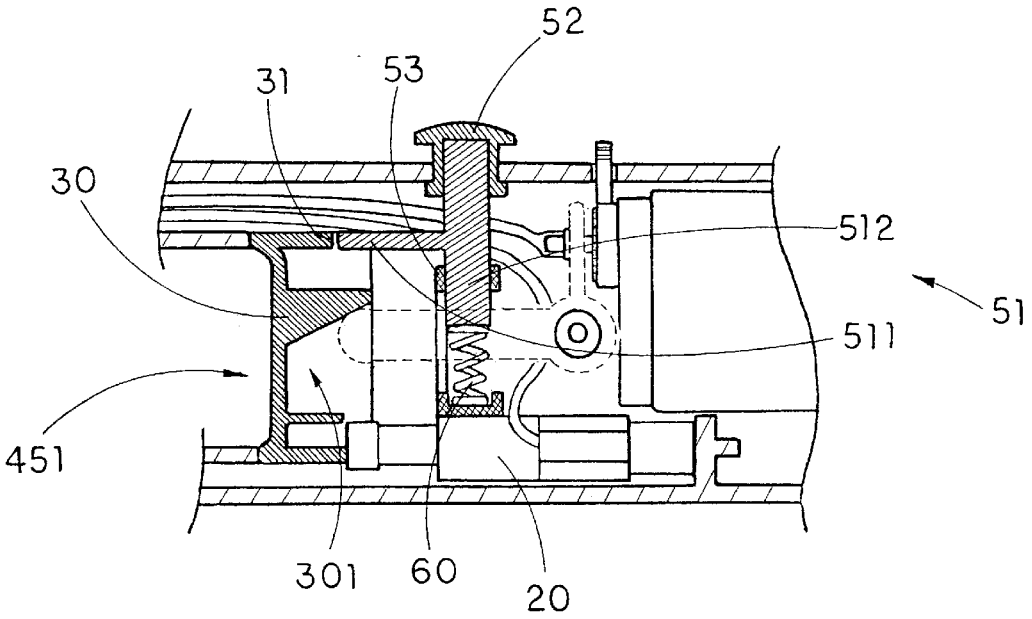
FIG. 4 is a partially sectional view of the multi-purpose lighter with child resistant device, during a locking condition, according to the above preferred embodiment of the present invention.

Referring to FIGS. 1 to 3 of the drawings, a multi-purpose lighter 1 with child resistant device 5 according to a preferred embodiment of the present invention. The multi-purpose lighter 1, such as a standard barbecue lighter, comprises a casing 10 comprising a liquefied gas storage 11 and a piezoelectric unit casing 12 which attached to the liquefied gas storage 11 and defines a trigger cavity 14 provided therein.

A gas emitting nozzle 13 is upwardly extended from a ceiling 101 of the casing 10 and communicated with the liquefied gas cavity 11. An elongated nozzle tube 131 is mounted on the ceiling 101 of the casing 10 for encircling the gas emitting nozzle 13. A flame regulator 15 is encircled the gas emitting nozzle 13 and controlled the flow of gas through the gas emitting nozzle 13. Thus, a finger guide 17, which is upwardly extended from an outer side of the trigger cavity 14 to the ceiling 101 of the casing 10, provides a finger cavity 451 therein fitting a user's finger engaged therethrough to press a trigger button 30.

A piezoelectric unit 20, which is disposed in the piezoelectric unit casing 12 of the casing 10 for generating piezoelectricity, comprises a movable operating part 21 extended upwardly, and an ignition tip 22 extended adjacent to the gas emitting nozzle 13, wherein when the movable operating part 21 of the piezoelectric unit 20 is compressed, sparks is generated from the ignition tip 22 to ignite the gas emitted from the gas emitting nozzle 13 at the same time.

The trigger button 30, which is disposed in the trigger cavity 14 of the casing 10 in a horizontally movable manner, having a U-shaped cross sectional structure defines a button cavity 301 therein wherein a bottom portion of the trigger button 30 is attached on the movable operating part 21 of the piezoelectric unit 20. The trigger button 30 is operatively connected both to the gas emitting nozzle 13 and to the piezoelectric unit 20 for striking spark in response to a push to the trigger button 30. When the trigger button 30 is pushed inward, the movable operating part 21 of the piezoelectric unit 20 is compressed for generating piezoelectricity through and out the igniting tip 22 towards the gas emitting nozzle 13. At the same time, a gas level 16 is simultaneously operated to release gas through the gas emitting nozzle 13 and the releasing gas will be ignited by striking spark ejected from the ignition tip 22.

As shown in FIG. 3, the multi-purpose lighter 1 further comprises a child resistant device 5 which comprises a lock member 50 slidably disposed in the casing 10, a blocking wall 31 formed on a top portion of the trigger button 30 wherein the blocking wall 31 is arranged to face the lock member 50, and a resilient element 60 disposed in the trigger cavity 14 for applying an urging pressure against the lock member 50 so as to normally retain the lock member 50 at the locking position.

The lock member 50 is slidably disposed in the casing 10 in a vertical movable manner wherein the lock member 50 comprises a lock button 52 mounted on a top wall of the casing 10 and a locker arm 51 downwardly extended from the lock button 52 into the trigger cavity 14 in such a manner the locker arm 51 is arranged to be driven by the lock button 52 to move from a normally locking position to an unlocked position. At the locking position, the locker arm 51 is extended to the blocking wall 31 for blocking up the trigger button 30 from being pushed inwardly so as to lock up the trigger button 30 from ignition, and that at the unlocked position, the locker arm 51 is moved to offset from the blocking wall 31 such that the trigger button 30 is capable of being pushed inwardly to ignite the multi-purpose lighter 1.

The L-shaped locker arm 51 has a horizontal upper portion 511 and a vertical lower portion 512 integrally extended from aside of the upper portion 511, as shown in FIG. 3. The upper portion 511 of the locker arm 51 is horizontally extended toward the blocking wall 31. The lower portion 512 of the locker arm 51 is downwardly extended toward the piezoelectric unit casing 12. Since the gas level 16 is positioned between the lock button 50 and the piezoelectric unit casing 12, the lower portion 512 of the locker arm 51 has to make a detour (extended aside from the upper portion 511) to extend to the piezoelectric unit casing 12, so as to provide more space for the gas level 16.

It is worth to mention that the blocking wall 31 has a predetermined thickness wherein when the lock member 50 is pressed downwardly, the locker arm 51 is moved away enough to offset from the blocking wall 31 of the trigger button 30 in such a manner the trigger button 30 is capable of moving inward to compress the piezoelectric unit 20. Furthermore, the upper portion 511 of the locker arm 51 has a length is shorter than a depth of the button cavity 301 of the trigger button 30 such that when the lock button 52 is compressed for unlocking the multi-purpose lighter 1, the trigger button 30 can move inward enough to compress the piezoelectric unit 20 to ignite the multi-purpose lighter 1. In other words, when igniting the multi-purpose lighter 1, the upper portion 511 of the locker arm 51 is disposed in the button cavity 301 of the trigger button 30.

In order to ensure the vertical movement of the locker arm 51, a pair of guiders 53 are inwardly projected from the casing 10 for guiding the lock member 50 to slide vertically wherein the two guiders 53 are extended at two sides of the lower portion 512 of the locker arm 51, as shown in FIG. 2. So, the locker arm 51 is slidably mounted between the two guiders 53 in a vertical movable manner, so as to prevent any lateral movement of the lock member 50.

The resilient element 60, according to the preferable embodiment of the present invention, is a compression spring which is disposed in the trigger cavity 14 so as to normally retain the locker arm 51 at the locking position. The resilient element 60 has two ends biasing against the lower portion 512 of the locker arm 51 at its bottom end 513 and the piezoelectric unit casing 12. The resilient element 60 will normally urge and retain the lock member 50 blocking up the trigger button 30 by blocking the inwardly movement of the trigger button 30 with the blocking wall 31 for preventing the ignition operation of the multi-purpose lighter 1.

In order to hold the resilient element 60 in position, the child resistant device 5 further comprises a holding member 61 downwardly protruded from the bottom end 513 of the second portion 512 of the locker arm 51 such that one end of the resilient element 60 is adapted to be engaged with the holding member 61. So, the resilient element 60 is securely held between the locker arm 51 and the piezoelectric unit casing 12.

Figure 5:
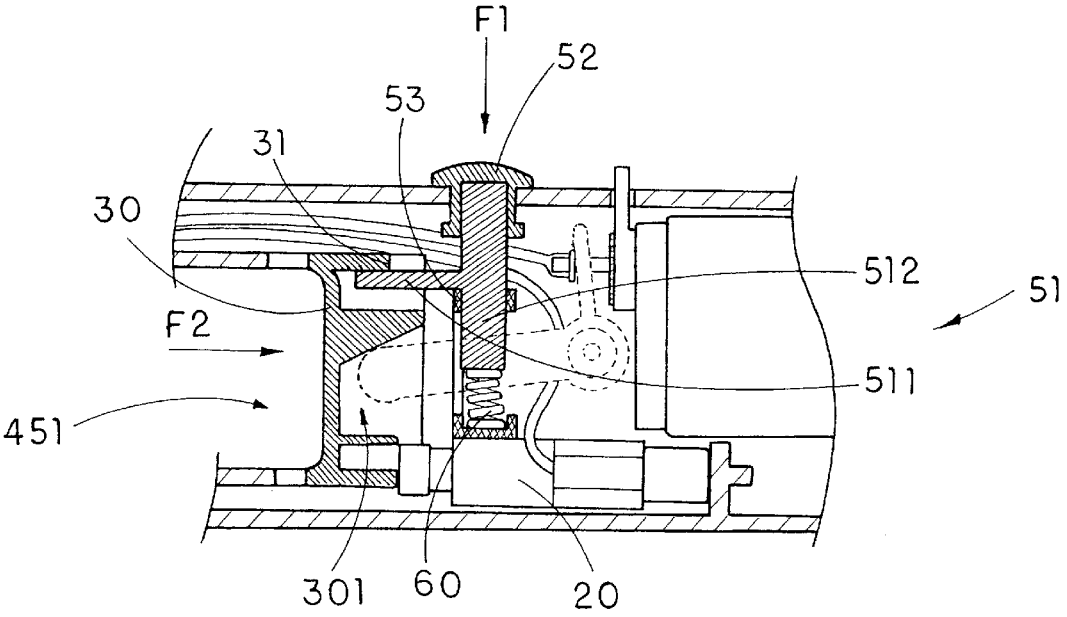
FIG. 5 is a partially sectional view of the multi-purpose lighter with child resistant device, during an unlocking condition, according to the above preferred embodiment of the present invention.

Referring to FIG. 5 of the drawings, in order to ignite the multi-purpose lighter 1, a pressing force F1 is intentionally applied on the lock button 52 of the lock member 50 such that the lock button 52 is arranged to drive the locker arm 51 to slide downward in such a manner the upper portion 511 of the locker arm 51 is moved offset from the blocking wall 31 on the trigger button 30. Then, the user can intentionally apply a pushing force F2 on the trigger button 30 in order to compress the piezoelectric unit 20 for generating piezoelectricity to ignite the multi-purpose lighter 1.

When the pushing force F2 applied on the trigger button 30 is released, the compressed piezoelectric unit 20 will then rebound to regain its original form that upwardly pushes the locker arm 51 back to its original lock up position, and rendering the trigger button 30 back to its origin position.

Thus, while releasing the pressing force F1 on the lock button 52, due to the compressing force of the resilient element 60 placed between the locker arm 51 and the piezoelectric unit casing 12, the lock member 50 will slide upwardly to the lock-up position by biasing the locker arm 51 against the blocking wall 31 of the trigger button 30.

What is claimed is:

1. A multi-purpose lighter, comprising:

a casing comprising a liquefied gas cavity and a piezoelectric unit casing which attached to said liquefied gas cavity and defines a trigger cavity therein, a gas emitting nozzle extended from and communicated with said liquefied gas cavity in said casing, an elongated nozzle tube mounting on a ceiling of said casing for encircling said gas emitting nozzle, a piezoelectric unit, which is disposed in said piezoelectric unit casing of said casing, comprising a movable operating part extended upwardly and an igniting tip extended adjacent to said gas emitting nozzle, a trigger button, which is disposed in said trigger cavity of said casing in a horizontally movable manner, being attached on said movable operating part of said piezoelectric unit in such a manner when said trigger button is pushed downward, said movable operating part of said piezoelectric unit is compressed for generating piezoelectricity and, at the same time, said gas emitting nozzle is actuated by a gas level to release gas within said liquefied gas cavity, and a child resistant device, comprising:

a lock member slidably disposed in said casing in a vertically movable manner comprising a lock button slidably mounted on a top wall of said casing and a locker arm downwardly extended into said trigger cavity in such a manner the locker arm is arranged to be driven by said lock button to move from a normally locking position to an unlocked position, wherein said locker arm has a horizontal upper portion and a vertical lower portion, wherein said lower portion of said locker arm is integrally and perpendicularly extended from said upper portion and extended towards said piezoelectric unit casing;

a blocking wall formed on a top portion of said trigger button wherein said blocking wall is facing toward to said locker arm, wherein said upper portion of said locker arm is extended toward said blocking wall;

a resilient element, which is disposed in said trigger cavity for applying an urging pressure against said locker arm so as to normally retain said lock member at said locking position, being mounted between said piezoelectric unit casing and a bottom end of said lower portion of said locker arm, wherein at said locking position, said lock member is extended to said blocking wall for blocking up said trigger button from being pushed inwardly so as to lock up said trigger button from ignition, and that at said unlocked position, said lock member is moved to offset from said blocking wall such that said trigger button is capable of being pushed inwardly to ignite said multi-purpose lighter.

2. A multi-purpose lighter, as recited in claim 1, wherein said trigger button having a U-shaped cross sectional structure defines a button cavity therein wherein a bottom portion of said trigger button is attached to said movable operating part of said piezoelectric unit.

3. A multi-purpose lighter, as recited in claim 2, wherein said lower portion of said locker arm is downwardly extended from a side of said upper portion thereof.

4. A multi-purpose lighter, as recited in claim 3, wherein said blocking wall has a predetermined thickness such that when said lock member is pressed downwardly, said locker arm is moved away enough to offset said blocking wall on said trigger button in such a manner said trigger button is capable of moving inward to compress said piezoelectric unit.

5. A multi-purpose lighter, as recited in claim 4, wherein said upper portion of said locker arm has a length is shorter than a depth of said button cavity of said trigger button such that when said lock button is compressed for unlocking said multi-purpose lighter, said trigger button can move inward enough to compress said piezoelectric unit to ignite said multi-purpose lighter in such a manner said upper portion of said locker arm is fitly disposed in said button cavity of said trigger button.

6. A multi-purpose lighter, as recited in claim 5, further comprises a pair of guiders inwardly projected from said casing for guiding said lock member to slide vertically wherein said two guiders are extended at two sides of said lower portion of said locker arm in such a manner said locker arm is slidably mounted between said two guiders in a vertical movable manner, so as to prevent any lateral movement of said lock member.

7. A multi-purpose lighter, as recited in claim 6, further comprises a holding member downwardly protruded from said bottom end of said lower portion of said locker arm such that one end of said resilient element is adapted to be engaged with said holding member for securely holding said resilient element between said locker arm and said piezoelectric unit casing.

8. A multi-purpose lighter, as recited in claim 5, further comprises a holding member downwardly protruded from said bottom end of said lower portion of said locker arm such that one end of said resilient element is adapted to be engaged with said holding member for securely holding said resilient element between said locker arm and said piezoelectric unit casing.

9. A multi-purpose lighter, as recited in claim 4, further comprises a pair of guiders inwardly projected from said casing for guiding said lock member to slide vertically wherein said two guiders are extended at two sides of said lower portion of said locker arm in such a manner said locker arm is slidably mounted between said two guiders in a vertical movable manner, so as to prevent any lateral movement of said lock member.

10. A multi-purpose lighter, as recited in claim 4, further comprises a holding member downwardly protruded from said bottom end of said lower portion of said locker arm such that one end of said resilient element is adapted to be engaged with said holding member for securely holding said resilient element between said locker arm and said piezoelectric unit casing.

11. A multi-purpose lighter, as recited in claim 3, wherein said upper portion of said locker arm has a length is shorter than a depth of said button cavity of said trigger button such that when said lock button is compressed for unlocking said multi-purpose lighter, said trigger button is adapted to move inward enough to compress said piezoelectric unit to ignite said multi-purpose lighter, in other words, said upper portion of said locker arm being inserted into said button cavity of said trigger button when igniting said multi-purpose lighter.

12. A multi-purpose lighter, as recited in claim 3, further comprises a pair of guiders inwardly projected from said casing for guiding said lock member to slide vertically wherein said two guiders are extended at two sides of said lower portion of said locker arm in such a manner said locker arm is slidably mounted between said two guiders in a vertical movable manner, so as to prevent any lateral movement of said lock member.

13. A multi-purpose lighter, as recited in claim 2, wherein said blocking wall has a predetermined thickness such that when said lock member is pressed downwardly, said locker arm is moved away enough to offset said blocking wall on said trigger button in such a manner said trigger button is capable of moving inward to compress said piezoelectric unit.

14. A multi-purpose lighter, as recited in claim 2, wherein said upper portion of said locker arm has a length is shorter than a depth of said button cavity of said trigger button such that when said lock button is compressed for unlocking said multi-purpose lighter, said trigger button is adapted to move inward enough to compress said piezoelectric unit to ignite said multi-purpose lighter, in other words, said upper portion of said locker arm being inserted into said button cavity of said trigger button when igniting said multi-purpose lighter.

15. A multi-purpose lighter, as recited in claim 1, wherein said lower portion of said locker arm is downwardly extended from a side of said upper portion thereof.

16. A multi-purpose lighter, as recited in claim 1, wherein said blocking wall has a predetermined thickness such that when said lock member is pressed downwardly, said locker arm is moved away enough to offset said blocking wall on said trigger button in such a manner said trigger button is capable of moving inward to compress said piezoelectric unit.

* * * * *